US005392763A

United States Patent [19]

Shaw et al.

[11] Patent Number: 5,392,763

[45] Date of Patent: Feb. 28, 1995

[54] GAS BURNER SYSTEM

[75] Inventors: Robert K. Shaw; McDonald Brian, both of Richmond Hill, Canada

[73] Assignee: Majco Building Specialties, L.P., Huntington, Ind.

[21] Appl. No.: 121,509

[22] Filed: Sep. 16, 1993

[51] Int. Cl.[6] ..... F24C 3/00

[52] U.S. Cl. ..... 126/512; 126/92 R; 431/125

[58] Field of Search ..... 126/512, 502, 92 R, 126/92 AC, 92 A, 91 R, 91 A; 431/125, 126

[56] References Cited

U.S. PATENT DOCUMENTS

| | | | |
|---|---|---|---|
| 4,838,240 | 6/1989 | Rieger | 126/92 R |
| 4,971,031 | 11/1990 | Richardson | 126/512 |
| 5,081,981 | 1/1992 | Beal | 126/512 |
| 5,114,336 | 5/1992 | Karabin et al. | 126/512 |

*Primary Examiner*—James C. Yeung
*Attorney, Agent, or Firm*—Baker & Daniels

[57] ABSTRACT

This gas burner system provides an asymmetrical flame pattern together with the presence of glowing embers around and beneath non-combustible logs, closely resembling the overall appearance of a natural wood fire in a fireplace. The burner system has a plurality of gas burner pipes arranged in a fan-out pattern on a log mounting plate to provide gas throughout the logs arranged over the plate. Air supply openings are formed at selected areas in the mounting plate to permit fresh air to pass only therethrough from below the mounting plate to the fire. Air deflectors are located adjacent to the openings and lava rock and/or mineral fiber pieces are placed below the logs over the gas burner pipes to disperse the combustible gas throughout the log arrangement. The provision of openings and deflectors create air currents flowing over the surfaces of the logs to prevent the flames from imposing on the log surfaces for reducing the formation of carbon deposits and carbon monoxide gas.

23 Claims, 3 Drawing Sheets

GAS BURNER SYSTEM

BACKGROUND OF THE INVENTION

This invention relates to gas burners and particularly relates to a burner system for natural gas or propane fireplaces, fireplace inserts and assemblies of gas burners with non-combustible fire logs provided thereon and commonly referred to as gas logs for use in a fire box of a gas fireplace.

Gas appliances for fireplaces are becoming more popular due to their convenience, cleanliness an economy in use. The flame patterns produced by gas appliances are, however, not comparable to those produced by burning natural wood logs in the fireplace. When wood logs are burned in a fireplace, the flames flicker in an attractive desirable asymmetrical fashion, originating randomly from the log arrangement and without reliance on linkage between other flames in the log arrangement. Flames can be seen to follow the contours of the logs as the flames rise above the logs. Glowing embers are interspersed around and under the burning logs throughout the burn area. Whereas in a gas fireplace, gas insert or gas logs, the flames appear in an orderly fashion in one or two parallel rows. If glowing embers are present, they usually appear in a linear arrangement along the base of the front row of flames.

Unlike wood fires, products which produce flames using natural gas or propane must meet strict safety requirements with respect to the amount of carbon monoxide that these appliances can produce as well as numerous operating characteristics which ensure a high level of safety. These requirements make it more difficult to produce a gas fire that is as appealing as a wood fire. For example, the generation of desirable tall yellow flames in a gas fireplace consistent with the appearance of flames of a wood fire in itself causes the inherent production of carbon monoxide. Moreover, additional and unacceptable levels of carbon monoxide can be generated when such yellow flames come in contact with the relatively cool surfaces of the non-combustible artificial logs commonly used in the gas fireplaces. Therefore, it becomes important to have a good measure of control over the gas flames so that the flames can be produced close to the non-combustible logs for added realism and also to minimize the flame impingement that can lead to the unacceptable levels of carbon monoxide as well as excessive carbon deposit.

With gas fireplaces, gas inserts and gas logs, it is common to have front and rear logs placed parallel to the face of the fireplace with continuous flames running in parallel lines in front and between these logs. These lower logs support one or more upper logs arranged in a transverse fashion over the lower logs. Such an arrangement of logs, results in the blockage of view to flames and embers as would be found in a wood fire. Furthermore, such an arrangement of logs produces flames appearing in an orderly fashion with an obvious connection to the other flames in the fire, and it is greatly lacking in realism to the usually random placement of logs and resulting flames in a natural wood fireplace.

SUMMARY OF THE INVENTION

It is the principal object of the present invention to provide a gas burner system which produces a flame pattern closely similar to that of burning natural wood logs in a fireplace.

It is another object of the present invention to provide a gas burner system having air supply controlled means to allow close placement of flames to the logs while preventing impingement of the flame on the log surfaces.

It is another object of the present invention to provide a gas burner system having an arrangement of logs providing a random and open appearance offering greater viewing area of flames and glowing embers.

It is another object of the present invention to provide a gas burner system producing pockets of flames and glowing embers around and underneath the logs throughout the burn area without obvious means of interconnecting to other parts of the fire.

It is another object of the present invention to provide a gas burner system having good combustion and burner operating characteristics to surpass national standards for such appliances.

It is yet another object of the present invention to provide a gas burner system that operates quietly without the common hissing sound of a gas-air mixture flowing through a metal burner under pressure.

Briefly, the gas burner system of the present invention comprises a mounting plate for supporting a plurality of non-combustible logs. The mounting plate is secured to the base of a fireplace grate when used in a gas log or it may be an integral part of the firebox floor of a gas fireplace or a fireplace insert. This mounting plate has a plurality of predetermined number of air supply openings formed at selected areas therein for allowing a supply of fresh air to rise only therethrough during operation, from below the mounting plate to the fire logs. A plurality of gas burner pipe means are disposed on the mounting plate. These gas burner pipe means extend in a fan-out pattern over the mounting plate, and they have a plurality of gas outlet ports formed therein. A gas supply means is connected to the gas pipe means and is operative to supply a combustible gas to specific areas beneath the non-combustible logs in a plurality of surface areas of the mounting plate. Air deflectors are provided on the mounting plate adjacent to the air supply openings so as to create a cushion of current of fresh air over the log surfaces when the fresh air rises through the air supply openings. The cushion of air current prevents flame impingement on the log surfaces so as to reduce the formation of carbon monoxide and carbon deposit in the ignition.

DESCRIPTION OF THE DRAWINGS

Other objects and advantages of the present invention will become apparent from the following detailed description of exemplary embodiments thereof in connection with the accompanying drawings in which.

DETAILED DESCRIPTION OF THE PREFERRED EMBODIMENTS

Figure 1:
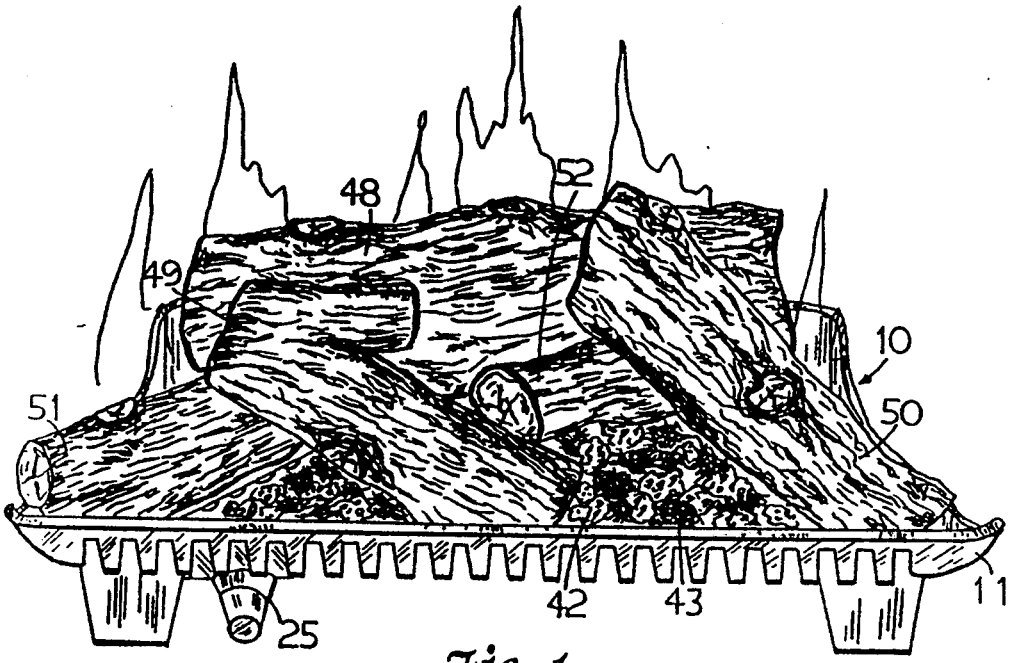
FIG. 1 is a front perspective elevation view of the gas burner system according to the present invention.
Figure 2:
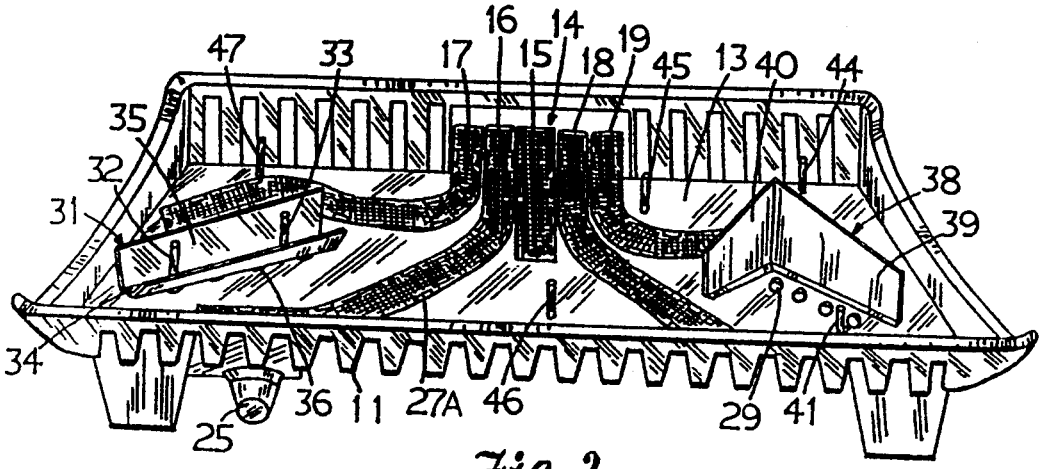
FIG. 2 is a perspective front elevation view of the grate thereof showing a fan-out pattern of the screened gas burner pipes and the location of the air supply openings and deflectors.

With reference to the drawings in which like reference numerals refer to like parts in the several views, the gas burner system 10 is generally shown in FIG. 1 with a plurality of non-combustible logs 11 disposed on a fireplace grate 12 as it would be employed in a gas log assembly. The non-combustible logs 11 are made of a refractory material such that they are not flammable and they have the appearance similar to that of natural wood fire logs. As best shown in FIG. 2, a mounting plate 13 is provided between the logs 11 and the grate 12. The mounting plate 13 has a plurality of gas burners 14 mounted thereon. Five gas burners are provided in a fan-out pattern in order to provide flames over a plurality of areas over the entire grate. The burners consists of a center gas burner 15, a first left side gas burner 16 having the rear portion therein juxtaposed with the center gas burner 15 and an end portion extending to the left corner of the mounting plate 13; an outer left side gas burner 17 having a rear portion juxtaposed to the rear portion of the first left side gas burner 16 and an end portion extending to the middle left side of the mounting plate 13; a first right side gas burner 18 having a rear portion juxtaposed with the rear portion of the center gas burner 15 and an end portion extending to the right corner of the mounting plate 13; and an outer right side gas burner 19 having a rear portion juxtaposed to the rear portion of the gas burner 18 and a rear portion extending to the middle side portion of the mounting plate 13.

Figure 3:
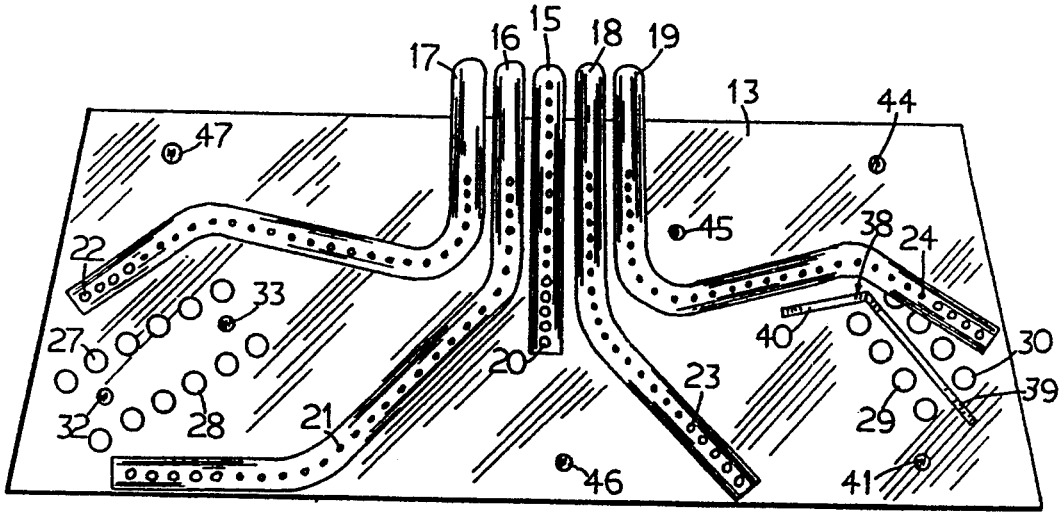
FIG. 3 is a top perspective elevation view of the mounting plate according to the present invention showing the pattern of gas burner pipes and air supply openings.
Figure 4:
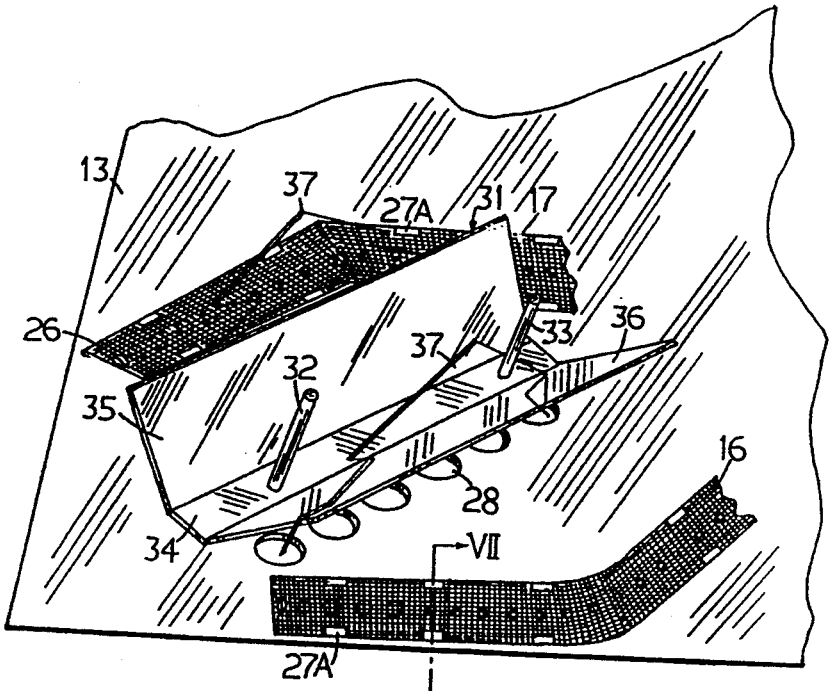
FIG. 4 is perspective isolated enlarged front elevation view of the area of the mounting plate in which the air supply openings and deflectors are located.

As shown in FIG. 3, a plurality of gas outlet ports 20 may be formed in the middle of the upper surface over the length of the end portion of the center gas burner 15. A plurality of gas outlet ports 21 are formed in the middle of the upper surface over the length of the end portion of the first left side gas burner 16. A plurality of gas outlet ports 22 are formed in the middle of the upper surface over the length of the end portion of the outer left side gas burner 17, and similarly a plurality of gas outlet ports 23 and 24 are formed along the middle of the upper surfaces of gas burners 18 and 19 respectively. The gas burners 15, 16, 17, 18 and 19 are connected to a gas supply manifold, and the gas flow to the manifold is controlled by the controller 25 mounted underneath the grate 11. Each one of the gas burners 15 through 19 may be coupled to the manifold through a separate control such that the pressure of the gas supply to each gas burner may be selected to provide various sizes of flames in operation. Selected ones of the gas outlet ports may also be provided with a larger diameter so as to provide larger flames at selected locations in the system. For example, the gas outlet ports formed in the end portion of the gas burner pipe may be provided with such larger diameters than the remaining gas outlet ports to provide such effect. The pilot flame ignition device for the gas burners is mounted at the rear end of the center gas burner 15 which serves to light the remaining gas burners 16 through 19 in operation by the flame carrying over to each successive burner at predetermined points where successive burners are in close proximity with one another along portions of the burner length provided with the gas outlet ports. The gas burners 15 through 19 are fully covered with a steel wire mesh or screen 26 which permits the gas emitted from the gas outlet ports of the gas burners to pass its openings. The screen 26 may be secured in place around the gas burners 15 through 19 respectively with metal clips 27A having a generally V-shape provided on the mounting plate 13.

Two rows of air supply openings 27 and 28 are formed in the mounting plate 13 in the area between the first left gas burner 16 and outer left gas burner 17 as best shown in FIG. 3. These air supply openings 27 and 28 permit air to be drawn upwards therethrough from below the grate 11 to the logs. Two additional rows of air supply openings 29 and 30 are formed adjacent to the extended portion of the outer right gas burner 19 on the mounting plate 13 to facilitate also the flow of air from below the mounting plate 13 to be drawn upwards therethrough.

An air deflector 31 is mounted on the mounting plate 13 and is located between the two rows of air supply openings 27 and 28 by mounting posts 32 and 33. The deflector 31 is in the form of a trough having a generally V-shaped cross section and having a narrow base portion 34 and two side walls 35 and 36 sloping upwardly and outwardly from the base portion 34. The side walls 35 and 36 extend in a spaced manner over the air supply openings 27 and 28 respectively in a canopy fashion such that air rising upwards through the air supply openings 27 and 28 will be deflected outwards by these sloping side walls 35 and 36 to rise over the sides of a log resting in the deflector 31. The rising air creates a cushion of air current 37 therein to prevent flame impingement on the logs surfaces. The mounting posts 32 and 33 also extend upwards above the base portion 34 to serve as log supporting means as outlined later in the following description.

The air deflector may be in another form as shown by the second air deflector 38 which has a generally L-shaped form mounted on the mounting plate 13. The air deflector 38 has a main panel 39 located between the air supply openings 29 and 30, and it has an upper edge sloping downwardly towards the front of the mounting plate 13. A cross panel 40 of the air deflector 38 extends at an angle to the main panel 39 and may have an upper edge sloping downwardly away from the main panel 39. Such sloping upper edges of the main panel 39 and cross panel 40 facilitate the positioning of a non-combustible log thereon such that the log would tilt at an angle to the horizontal plane to allow the air rising from the air supply openings 29 and 30 to flow towards the bottom of the log first and then rising upwards over its side surfaces to create a cushion of air current therein thus preventing the flame from impinging upon the surfaces of the log. A mounting post 41 may be provided on the mounting plate 13 to retain the lower end of the log to safely positioning the log on the deflector 38.

A plurality of pieces of non-combustible lava rock 42 and mineral fibre 43 serving as simulated embers are placed on an around the wire mesh screen 26 covering over the gas burners in a random fashion to produce the desired glowing ember effect when these embers 42 and 43 are in direct contact with the flames and are heated by the flames to a red hot condition.

Log support posts 44, 45, 46 and 47 are provided throughout the mounting plate 13 to support and space the non-combustible logs 48, 49, 50, 51 and 52 above the surface of the mounting plate 13 such that the lava rock 42 and mineral fibre 43 pieces are located below the non-combustible logs. During operation the lava rock and mineral fibre pieces provide a glowing ember effect around and below the logs to simulate that which exists in a natural wood log fire. The log support posts also enable a plurality of logs to be place at various areas of the mounting plate 13 so that it would provide a visual impression to the viewer as if the logs are placed randomly over the grate 11.

The center gas burner 15 serves two purposes, namely it serves to carry the ignition from the pilot flame to the other gas burners, and it also serves as the primary gas burner for providing a large central flame over the burner assembly. Such a large central flame is particularly desirable in providing an attractive flame pattern to the viewer.

Figure 5:
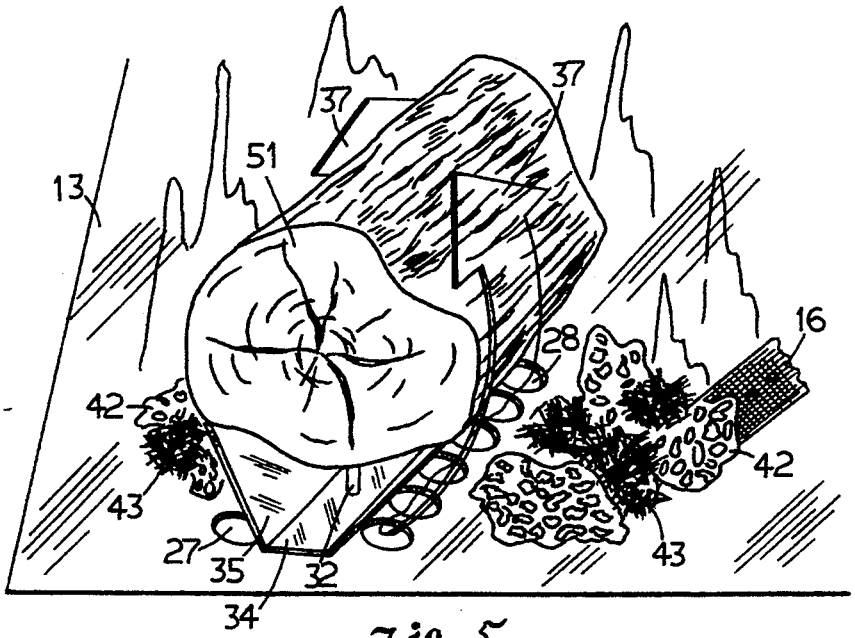
FIG. 5 is another isolated front elevation enlarged view of the area of the mounting plate in which the air cushion is formed over the log surfaces, and the placement of lava rock and mineral fibre pieces over the screened gas burner pipes thereof.
Figure 6:
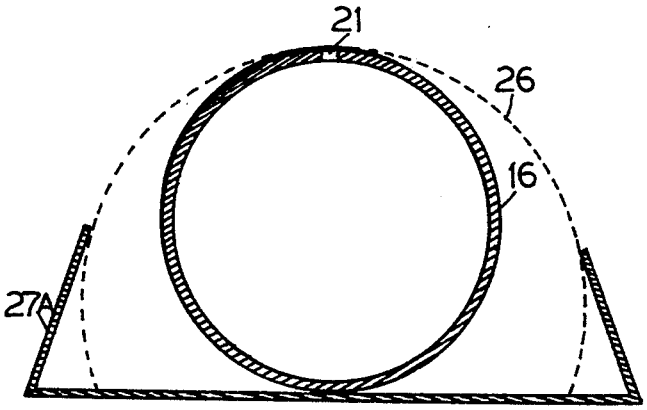
FIG. 6 is a perspective view of the retaining clips for the screen over the gas burner pipes.
Figure 7:
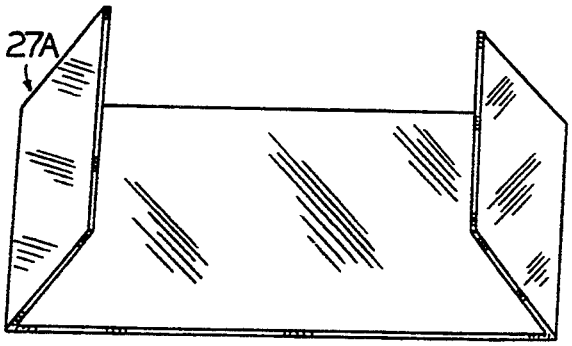
FIG. 7 is an enlarged sectional side elevation along section line VII—VII in FIG. 4.

As best shown in FIG. 5, during operation, the vertical flow of air takes place through the air supply openings in the mounting plate 13. The deflector 31 located between the two rows of air supply openings helps to direct the air to the sides of the log thereby creating a vertically flowing cushion of air current 37 against the surfaces of the log. Heat generated by the burners promotes the flow of air upwards through the air supply openings. Air replacing that consumed by the combustion process also promotes the flow of air upwards through the air supply openings. The effect of this flowing air cushion will keep the flames from coming in contact with the surfaces of the log. The amount of air cushion varies and may typically be a few millimeters thick flowing upwards over the surfaces of the log, as a result the flames follow the surface contour of the log even through they are being pushed away from the log surfaces. This process creates a high level of realism for the gas fire to simulate that of the appearance of a wood fire. The effect of this flowing air cushion is increased with a glass front. With an enclosed firebox the air openings available for air to enter the firebox to replace the air exhausted through the chimney vent are reduced. This condition causes an increased firebox depressurization relative to the room to which the fireplace faces and the atmosphere immediately outside the building in which the gas appliance is installed. If the mounting plate 13 is an integral part of the gas fireplace or gas insert firebox floor, the air from below the firebox floor which, by design, is always in communication with the room the fireplace faces or with the outside atmosphere, would be in a higher pressure zone than inside the firebox. The result is an increased air flow through the air supply openings 27 through 30 upwards over the surfaces of the logs thereby increasing the resistance to flame impingement on the log surfaces.

A single layer of lava rock and mineral fibre pieces is required in the burner system. The lava rock and mineral fibre pieces together with the screen 26 also serve to disperse the gas releasing from the outlet ports of the burners resulting in alleviating the hissing sound the gas-air mixture flowing through the outlet ports under pressure, which exists in common gas burners. A large amount of lava rock and mineral fibre pieces, however, may have a smothering effect on the flame to decrease its visible size and introducing more blue colour into the flame and reducing the attractiveness of the fire.

Various changes and modifications may be made within this invention as will be readily apparent to those skilled in the art. Such changes and modifications are within the scope and teaching of this invention as defined by the claims appended hereto.

What is claimed is:

1. A gas burner system for fireplaces comprising:

a mounting plate for supporting a plurality of non-combustible fire logs, a plurality of air supply openings formed at selected locations of said mounting plate and being operative for allowing air to rise therethrough from below said mounting plate to the fire logs, a gas burner assembly disposed on said mounting plate, said gas burner assembly comprising a plurality of pipes having a plurality of gas outlet ports formed therein, said gas burner pipes having a fanned out pattern on said mounting plate and being operative to supply a combustible gas over a plurality of surface locations of said mounting plate.

2. A gas burner system according to claim 1 including a screen means disposed over said gas burner pipes, and a plurality of non-combustible ember members disposed over said screen means and being located above selected ones of said gas outlet ports of said gas burner pipes.

3. A gas burner system according to claim 2 wherein said screen means are secured over said gas burner pipes with a plurality of substantially U-shaped mounting clip members provided over said mounting plate.

4. A gas burner system according to claim 1 including log supporting means disposed at selected log placement locations on said mounting plate.

5. A gas burner system according to claim 4 including a plurality of non-combustible fire logs disposed at said log placement locations.

6. A gas burner system according to claim 5 wherein said non-combustible ember members are lava rock and mineral fibre pieces.

7. A gas burner system according to claim 5 including air deflector means disposed adjacent to said air supply openings, said deflector means being operative to guide the air to rise upwards from below said mounting plate through said air supply openings to form an air cushion over the surface of a fire log placed on said deflector means.

8. The burner system of claim 1 wherein said pipes are non-branched.

9. The burner system of claim 1 wherein some of said pipes are each bent at a plurality of locations.

10. A gas burner system for gas fireplaces comprising a mounting plate for supporting a plurality of non-combustible fire logs thereon, a burner assembly mounted on said mounting plate, said burner assembly having a plurality of elongated gas burner pipes forming a fanned out pattern on said mounting plate and being operative for supplying a combustible gas to a plurality of surface locations of said mounting plate, said gas burner pipes having a plurality of gas outlet ports formed on upper portions thereof, screen means disposed over said gas burner pipes, a manifold coupled to said burner assembly and operative to supply combustible gas to said gas burner pipes, a plurality of air supply openings formed in said mounting plate, at least one air deflector mounted on said mounting plate and located adjacent to said air supply openings, and log supporting means provided at said air deflector means and operative for supporting a non-combustible fire log.

11. A gas burner system according to claim 10 wherein said log supporting means comprises a trough means having a substantially V-shaped cross sectional shape including a narrow base portion and two upstanding side wall members sloping upwardly divergently from said base portion, said side wall members being located in a canopy manner over said air supply openings.

12. A gas burner system of claim 11 wherein said air supply openings comprises two rows of openings, and said log supporting means comprises an L-shaped member having an upstanding main panel member extending upwards from said mounting plate and being located in between two rows of air supply openings, and a transverse panel member extending at an angle from one end of said main panel member and upwards from said mounting plate, said main panel and said transverse panel member having upper edges operative for supporting a non-combustible fire log to rest over said air supply openings in a spaced manner.

13. A gas burner system of claim 12 including a plurality of non-combustible ember members disposed over said screen means and over selected ones of said gas outlet ports.

14. A gas burner system of claim 13 wherein said ember members are lava rock and mineral fibre pieces.

15. A gas burner system of claim 14 wherein said upper edges of said log supporting means are sloping downwardly from a common point towards a distal free end therein.

16. A gas burner system of claim 10 wherein each one of said gas burner pipe means is coupled through a separate control means to said manifold means.

17. A gas burner system of claim 16 wherein said gas outlet ports have different diameters of opening.

18. A gas burner system for fireplaces comprising:

a mounting plate for supporting a plurality of non-combustible fire logs, a plurality of air supply openings formed at selected locations of said mounting plate and being operative for allowing air to rise therethrough from below said mounting plate to said fire logs, a gas burner assembly disposed on said mounting plate, said gas burner assembly comprising a plurality of pipes having a plurality of gas outlet ports formed therein, said gas burner pipes having a spread out pattern on said mounting plate and being operative to supply a combustible gas over a plurality of surface locations of said mounting plate, at least one non-combustible log positioned in proximity to a plurality of said air supply openings, and at least one air deflector disposed adjacent said log and air supply openings to direct air rising through said openings around said log, whereby an air cushion is formed on the surface of said log.

19. A gas burner system according to claim 18 wherein said deflector comprises a trough member having generally V-shaped cross section and having two side walls sloping upwardly and outwardly from a narrow base portion, and said fire log is disposed in said trough member.

20. A gas burner system according to claim 19 wherein said side walls of said deflector are located in a canopy manner over said air supply openings.

21. A gas burner system according to claim 19 including two securing means for mounting said trough member to said mounting plate, said securing means having an upper portion extending upwards from said trough means and being operative to support said fire logs.

22. The burner system of claim 18 wherein said log is supported by said deflector.

23. The burner system of claim 18 wherein said plurality of burner pipes originate from a position near an edge of said plate and diverge outwardly in a fanned out fashion from said originating position.

* * * * *

UNITED STATES PATENT AND TRADEMARK OFFICE

CERTIFICATE OF CORRECTION

PATENT NO. : 5,392,763

DATED : February 28, 1995

INVENTOR(S) : Robert K. Shaw et al

It is certified that error appears in the above-indentified patent and that said Letters Patent is hereby corrected as shown below:

On the cover page of the patent under "[75] Inventors:" change "McDonald Brian" to --Brian McDonald--.

In the Abstract, line 17, change "imposing" to --impinging--.

Claim 7, column 6, line 46, change "surface" to --surfaces--.

Signed and Sealed this

Fourth Day of July, 1995

Bruce Lehman

*Attest:*

BRUCE LEHMAN

*Attesting Officer*

*Commissioner of Patents and Trademarks*